US006244993B1

(12) United States Patent
Dunn

(10) Patent No.: US 6,244,993 B1
(45) Date of Patent: Jun. 12, 2001

(54) PUNCH BAG

(76) Inventor: Colin Dunn, 14 Harebell Close, Huntington, Chester, Cheshire, CH3 6RT (GB)

( * ) Notice: Subject to any disclaimer, the term of this patent is extended or adjusted under 35 U.S.C. 154(b) by 0 days.

(21) Appl. No.: 09/270,226

(22) Filed: Mar. 15, 1999

(30) Foreign Application Priority Data

Mar. 16, 1998 (GB) ..... 9805393

(51) Int. Cl.[7] ..... A63B 69/00
(52) U.S. Cl. ..... 482/83; 482/87; 482/90
(58) Field of Search ..... 482/83–90; 446/268

(56) References Cited

U.S. PATENT DOCUMENTS

| | | | | |
|---|---|---|---|---|
| 124,588 | * | 3/1872 | Kehoe | 482/83 |
| 3,785,643 | * | 1/1974 | Rich | 482/87 |
| 4,103,889 | * | 8/1978 | Labur | 482/83 |
| 4,434,980 | * | 3/1984 | Babineaux | 482/87 |
| 4,557,477 | * | 12/1985 | Clements et al. | 482/87 |
| 5,183,450 | | 2/1993 | Stelmach | 482/83 |

* cited by examiner

*Primary Examiner*—Jerome Donnelly
(74) *Attorney, Agent, or Firm*—Lahive & Cockfield, LLP

(57) ABSTRACT

A punch bag comprises a primary bag 2 for suspension from a ceiling and a secondary bag 6 secured to the bottom of the bag 2 by a cord. The secondary bag may have a mass of between 25% and 100% of the mass of the primary bag.

12 Claims, 1 Drawing Sheet

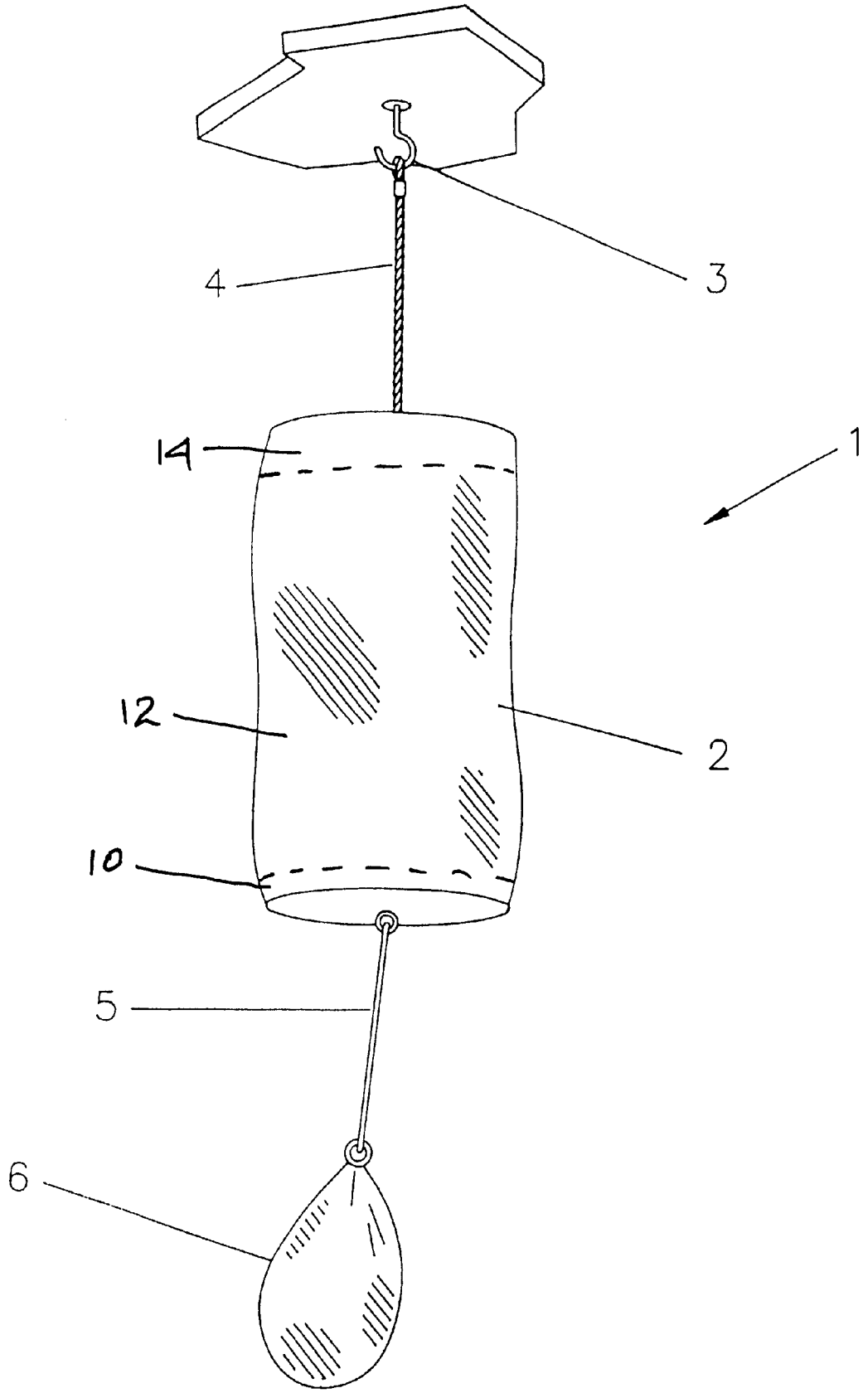
3
4
14
1
12
2
10
5
6

PUNCH BAG

The present invention relates to apparatus such as punch bags, punch balls, suspended punch balls, and stacked punch balls for use, inter alia, as a training aid for boxers and other athletes. Such apparatus will hereinafter be referred to simply as a "punch bag".

Punch bags, as a training aid for boxers, are well known. They usually consist of a cylindrical bag containing a relatively soft filling, such as cotton waste, with a cord to suspend one end of the cylindrical bag from the ceiling or other high fixing point provided by a frame. When the bag is punched it swings in one direction and its return swing path is generally predictable.

The present invention seeks to provided a punch bag which has an unpredictable motion more readily to simulate the movements of an opponent boxer.

According to the present invention there is provided a punch bag comprising a primary bag, a cord to support the primary bag from an elevated point, and a weight connected to and adapted to swing relative to the primary bag.

Preferably the weight is a secondary bag. Preferably the primary bag is filled with material to absorb an impact.

Preferably the weight is connected to the bottom of the primary bag. Preferably the weight is connected to the primary bag by a cord. The cord may be elasticated.

The weight may be between 25% and 100% of the weight of the primary bag, and is preferably between 80% and 90% of the weight of the primary bag.

An embodiment of the present invention will now be described, by way of example, with reference to the accompanying drawing which is a perspective view of a punch bag according to the present invention.

Referring now to the drawing, there is shown a punch bag 1 having a primary bag 2. The top of the bag 2 is connected to a hook 3 at an elevated point such as the ceiling of a gymnasium by a cord 4. The primary bag 2 is generally cylindrical in shape and has in this embodiment a cover formed of leather.

Inside the cover are three layers of filling; at the bottom of the bag is a layer 10 of dense, impact absorbing material, in this embodiment sand, above which is a layer 12 of relatively soft filling material, in this embodiment cotton waste, and at the top a third layer 14 of resilient material such as sponge. Although the second layer is composed of cotton waste it is packed so tightly that layer is also resilient. The top layer occupies the top 10% to 15% of the length of the primary bag.

Connected to the bottom of the primary bag 2 by a cord 5 is a weight in the form of secondary bag 6 comprising a cover filled with an impact absorbing material, in this embodiment sand. The cover of the secondary bag 6 may be made of any suitable material such as polyvinylchloride (PVC) or leather. The weight of the secondary bag 6 is at least 25% of the weight of the primary bag 2, and preferably, as in this embodiment, has a weight of between 80% and 90% of the weight of the primary bag 2.

In this embodiment, the primary bag 2 is about 35 inches long and weighs about 27 lbs of which the first layer 10 of sand weighs about 6½lbs, the second layer 12 of cotton waste weighs about 13½lbs, and the top layer 14 of sponge weighs about 2 lbs, the balance of the weight being the weight of the cover. The centre of gravity the primary bag 2 is about 25% of the bag length from the bottom of the bag. The secondary bag has a centre of gravity about 30inches below the bottom of the primary bag 2.

In use, the primary bag 2 is used as a target by a boxer. However as the primary bag 2 swings as it is struck, so the secondary bag 6 swings in a direction different to that of the primary bag 2. This imparts forces on the primary bag 2 such that its swing direction is unpredictable, and hence this simulates the random movement of an opponent boxer. The user needs greater concentration, co-ordination, skill and energy compared with training with a known punch bag.

The primary bag is generally level with the torso of a boxer and ideally its height above the ground is adjusted for different sizes of boxer. This adjustment should not increase the effective length of the cord 4 to more than the distance of the centre of gravity of the primary bag from the top of the primary bag.

The invention could take a different form to that described above. For example the cord 5 could be replaced by an elastic cord, and the secondary bag 6 could be a simple weight. The secondary bag 6 could also be connected to a point on the primary bag 2 other than the bottom of the bag 2.

Also, the length and weight of the primary bag can be varied to suit different boxers, but the centre of gravity of the primary bag should be between 5% and 40% of the length of the bag from the bottom of the bag. When the weight of the primary bag is changed from that described, the weights of the individual layers are changed in proportion.

In a modified embodiment the third layer 12 of sponge is omitted and replaced by the same weight of the material of the second layer.

Each layer may consist of mixtures of suitable material, and if desired more than three layers may be provided.

What is claimed is:

1. A punch bag comprising a primary bag, a cord to support the primary bag from an elevated point, and a weight connected to and adapted to swing relative to the primary bag, the primary bag having a cover and at least two layers of filling located in the cover, a lower layer of the filling being of a dense impact absorbing material and an upper layer of filling being of a resilient material, and wherein the primary bag has a center of gravity located between 5% and 40% of the lenght of the bag from the bottom of the bag.

2. A punch bag as claimed in claim 1, in which the weight is a secondary bag.

3. A punch bag as claimed in claim 2, wherein the weight is connected to the bottom of the primary bag.

4. A punch bag as claimed in claim 3, wherein the weight is connected to the primary bag by a cord.

5. A punch bag as claimed in claim 4, wherein the cord is elastic.

6. A punch bag as claimed in claim 4, wherein the weight is between 25% and 100% of the weight of the primary bag.

7. A punch bag as claimed in claim 1, wherein the weight is between 25% and 100% of the weight of the primary bag.

8. A punch bag as claimed in claim 7, wherein the weight is between 80% and 90% of the weight of the primary bag.

9. A punch bag as claimed in claim 6, wherein the weight is between 80% and 90% of the weight of the primary bag.

10. A punch bag as claimed in claim 1, further comprises a third layer of resilient material located above the upper layer.

11. A punch bag as claimed in claim 10, wherein the second layer is composed of a soft filling material.

12. A punch bag as claimed in claim 6, further comprises a third layer of resilient material located above the upper layer.

* * * * *